United States Patent [19]

Larriva

[11] Patent Number: 4,490,993

[45] Date of Patent: Jan. 1, 1985

[54] CONDENSING APPARATUS AND METHOD

[76] Inventor: R. Marion Larriva, 5020 E. First St., Tucson, Ariz. 85711

[21] Appl. No.: 427,868

[22] Filed: Sep. 29, 1982

[51] Int. Cl.[3] ..... F28D 5/00

[52] U.S. Cl. ..... 62/304; 62/513

[58] Field of Search ..... 62/304, 305, 170, 171, 62/172, 513, 91

[56] References Cited

U.S. PATENT DOCUMENTS

| | | | |
|---|---|---|---|
| 3,132,190 | 5/1964 | Engalitchett | 62/305 X |
| 3,947,146 | 3/1976 | Schuster | 62/305 |
| 4,028,440 | 6/1977 | Engalitchett, Jr. | 62/305 X |
| 4,182,131 | 1/1980 | Marshall et al. | 62/305 X |

*Primary Examiner*—Henry Bennett

*Attorney, Agent, or Firm*—Don J. Flickinger

[57] ABSTRACT

A condensing apparatus includes at least one stack of condensing coils each of which have a common feed header and a common outlet header. The stack is positioned within a cabinet and may be air cooled and/or water cooled. The feed header is coupled to receive hot compressed vapor which is converted to a cool liquid and collected at the outlet header. Several stacks may be employed and used in conjunction with liquid to vapor modules wherein cool liquid is flashed into a hot vapor stream to produce a cool vapor which is then introduced into the feed header of a subsequent stack of condensing coils.

7 Claims, 6 Drawing Figures

FIG. 1
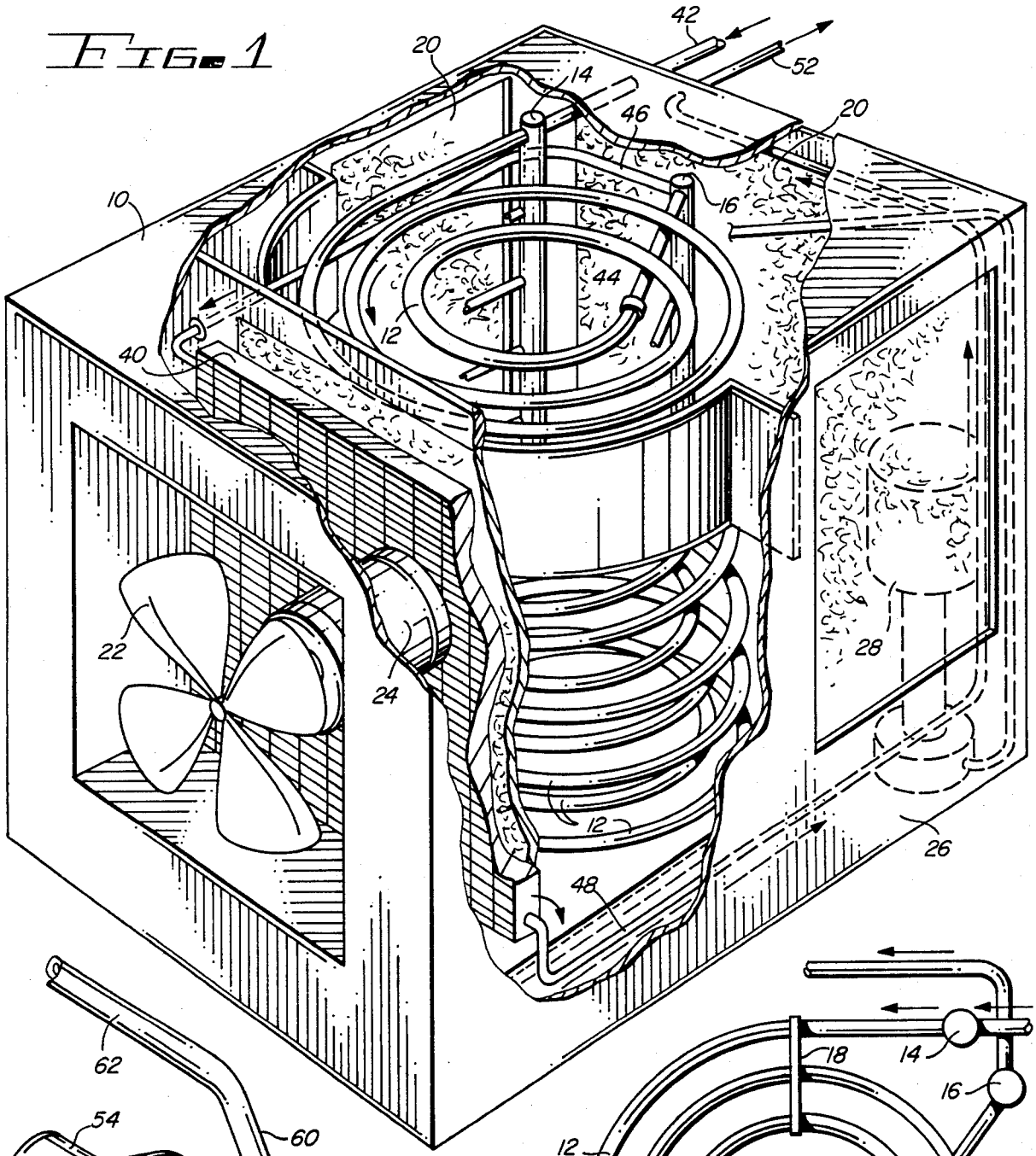
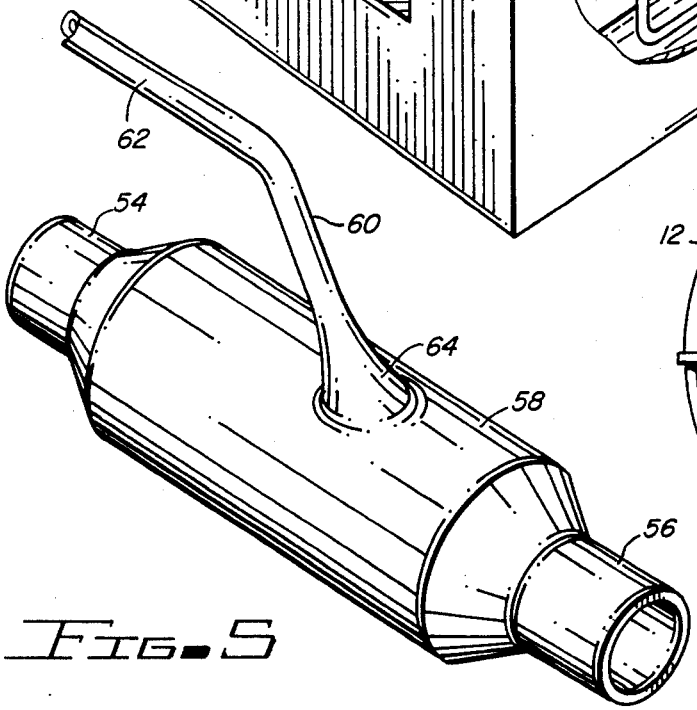
FIG. 5
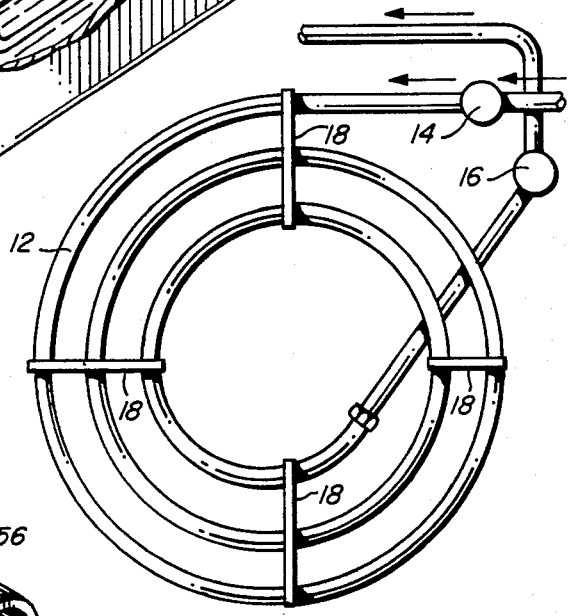
FIG. 4

CONDENSING APPARATUS AND METHOD

BACKGROUND OF THE INVENTION

1. Field of the Invention

This invention relates generally to an apparatus for condensing a vaporizable liquid and, more particularly, to an apparatus for condensing a vaporized refrigerant in a cooling unit.

2. Prior Art

In a conventional compressor-type refrigeration unit, hot compressed refrigerant vapor is piped from a compressor to one end of a condensor, and cooled refrigerant liquid is piped from the other end of the condensor and conveyed to an expansion valve or refrigeration control. Expanded, cold refrigerant vapor flows through a cooling coil and back to the compressor.

Such refrigeration units are generally intended to operate in ambient temperatures not higher than approximately 95° F. (35° C.). In the South and the Southwest, however, summer temperatures are often significantly higher. To accommodate these higher temperatures, approaches such as multi-compressor units and water cooled condensers have been employed. Unfortunately, multi-compressor units require more energy and are therefore more expensive to operate. Water cooled condensers suffer from the disadvantage that insulating deposits (e.g., calcium) from the cooling water are formed on the condensing surfaces, especially the secondary condensing surfaces such as fins. This results in increased maintenance and a reduction in heat transfer.

It is an object of the present invention to provide an improved apparatus for condensing a vaporizable liquid.

It is a further object of the present invention to provide an improved condensing apparatus for use in refrigeration units, or processes requiring fast condensation, such as gasoline condensation etc.

It is yet a further object of the present invention to provide a condensing apparatus for use in refrigeration units which comprises a large prime condensing surface resulting in increased efficiency of heat transfer from refrigerant to cooling medium.

It is still further object of the invention to provide a condensing apparatus for use in refrigeration units which is configured so as to minimize the formation of calcium deposits from water which is used to cool the condensing coils. The first one or more coils of condenser tubing are not desuperheated but do receive the coldest water from various sprays and this accomplishes desuperheating. All of the remaining condenser coils are desuperheated by modules. Therefore, the entire condenser system is 100% desuperheated. Water reaching the condenser coils is also sprayed from points between evaporator pads and coils resulting in additional evaporation and cooling by incoming air. All the condenser tubes are always wet, and this retards accumulation of alkali on the condenser coils. Condenser coils alkali generally because the overall temperature very seldom exceeds approximately 94° F. peak heat at the condenser coils.

SUMMARY OF THE INVENTION

According to a broad aspect of the invention, there is provided a condensing apparatus which converts a hot vapor into a cool liquid and comprises a plurality of condensing coils in a stacked configuration each coil having an inlet and an outlet. A feed header is coupled to the inlet at each of the coils for conveying hot vapor thereto, and an outlet header is coupled to the outlet of each of the coils for receiving cooled liquid therefrom.

According to a further aspect of the invention, there is provided an apparatus for cooling a hot vapor which comprises a first tube having an inlet section, an outlet section and an intermediate section, said inlet section for receiving a hot vapor flow. A second tube has an inlet and an outlet, which outlet is coupled to the intermediate section of the first tube for introducing a cool liquid therein which is flashed into a vapor to produce a cooled vapor at the outlet section. The intermediate section is of a diameter greater than that of the inlet and outlet sections, and the outlet of the second tube may be flared to facilitate introduction of the cooled liquid into the intermediate section.

According to a still further aspect of the invention, there is provided a condensing apparatus for converting a hot vapor which is discharged at the outlet of a compressor into a cooled liquid, comprising a first stack of a first plurality of condensing coils having a feed header coupled to the outlet of the compressor for supplying hot vapor to each of the first plurality of coils and having an outlet header for receiving cooled liquid from the first plurality of coils. At least a second stack of a second plurality of condensing coils has a feed header for supplying vapor to each of the second coils and has an outlet header for receiving cooled liquid from the second plurality of coils. A vapor cooling module, having first and second inputs and having an output coupled to the feed header of the second stack, has its first input coupled to the output of the compressor for receiving hot vapor and its second input coupled to the outlet header of the first stack for receiving cooled liquid. In this manner, cooled liquid is supplied to the intermediate section to produce a cooled vapor at the feed header of the second stack.

BRIEF DESCRIPTION OF THE DRAWINGS

The above and other objects, features, and advantages of the present invention will be more clearly understood from the following detailed description taken in conjunction with the accompanying drawings, in which:

FIG. 1 is an isometric, partially cutaway view illustrating the inventive condensing apparatus;

FIG. 4 is a plan view illustrating a single condensing coil in accordance with the present invention;

FIG. 5 is an isometric view of a liquid-to-vapor module for introducing cool refrigerant liquid into a hot vapor flow.

DESCRIPTION OF THE PREFERRED EMBODIMENTS

Figure 2:
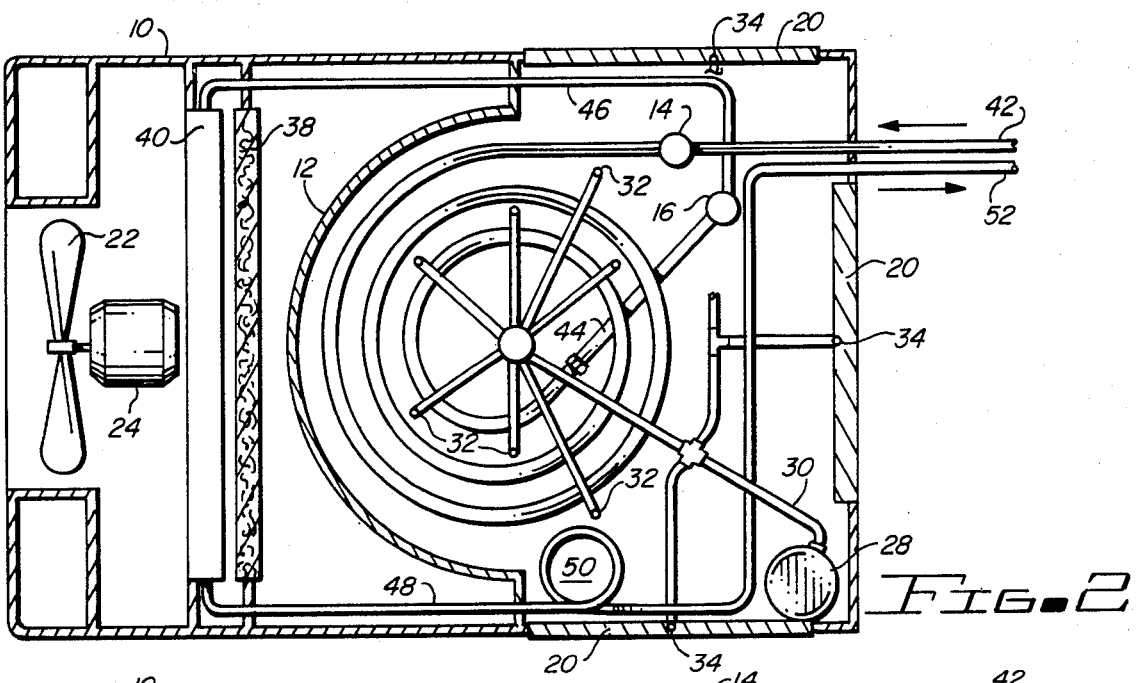
FIG. 2 is a top view of the condensing apparatus shown in FIG. 1.
Figure 3:
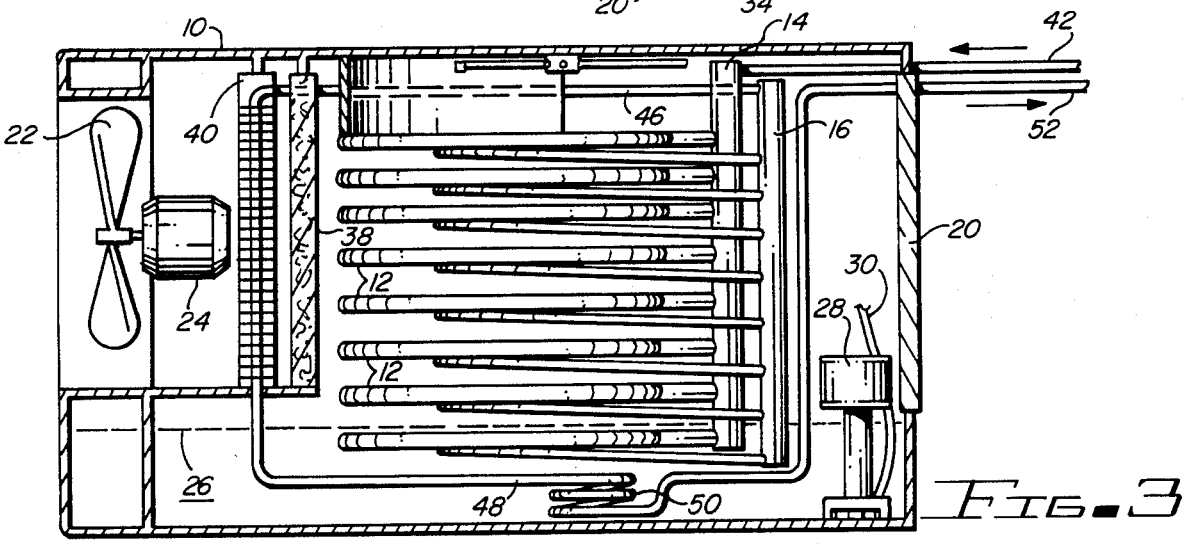
FIG. 3 is a side view of the inventive condensing apparatus shown in FIGS. 1 and 2.

Referring to FIGS. 1, 2 and 3, a cabinet, or housing, 10 has mounted therein a plurality of mounting coils 12 stacked in parallel each of which is coupled to a common feed header 14 and a common outlet header 16.

Referring momentarily to FIG. 4, a single one of the stacked coils 12 is illustrated as being coupled to feed header 14 and outlet header 16. The coil 12 may be formed from commercially available cooper tubing. As shown in FIG. 4, separating bars 18 may be employed to enhance the rigidity of the coil 12, and also allow space for airflow through condenser coils.

Referring again to FIGS. 1, 2 and 3, the stacking of the coils 12 in a parallel arrangement and the use of a common feed header 14 and a common outlet header 16 promote a low back pressure and provide a large prime condensing surface thereby increasing efficiency of heat transfer from the refrigerant carried within the stacked coils to the cooling medium.

Air from outside cabinet 10 is drawn through evaporator pads 20 by means of a fan 22 driven by motor 24. For the sake of clarity, the standard conventional electrical connections have not been shown.

Air which passes through evaporator pads 20 becomes precooled and flows past and over condensing coils 12. Coils 12, which may be stacked in either a vertical or horizontal direction, are cooled by the air flow. Furthermore, water is drawn from a lower portion 26 of cabinet 10 by pump 28 and supplied via a hose 30 to a plurality of spray nozzles 32 positioned above and alongside coils 12 and to a plurality of spray nozzles 34 positioned proximate the evaporator pads 20 for the purpose of moistening same. The air which does not become cool and moist passes through a filter 38 which blocks larger moisture particles and then through a condensor 40 after which it exits to fan 22 to the exterior of the cabinet 10.

Evaporation, hot refrigerant vapor from a compressor discharge line 42 enters feed header 14 and is supplied to coils 12. The refrigerant, after being cooled in the coils 12 by the passing air and water, leaves the coils 12 via outlet tubes 44, outlet header 16 and flows via output line 46 to condensor 40. The refrigerant leaves the condensor via tube 48 and passes through a submerged coil 50. Finally, the cooled refrigerant liquid exits the cabinet 10 via line 52.

FIG. 5 is an isometric view of a liquid-to-vapor module which comprises an inlet portion 54, an outlet portion 56, a hollow cylindrical portion 58 having a diameter which is greater than that of inlet tube 54 and outlet tube 56, and a flared tube 60 having an inlet end 62 and a flared outlet end 64 which is coupled to cylindrical portion 58. The liquid-to-vapor module is used to introduce cooled refrigerant liquid via fluid tube 16 into a stream of superheated refrigerant vapor which is flowing from inlet tube 54 to outlet tube 56 via cylindrical portion 58. The liquid is released via the fluid tube into a stream of superheated refrigerant vapor. The greater velocity of the vapor creates a siphoning effect which aids in introducing the cooled liquid. Upon introduction into cylindrical portion 58, the cooled liquid is flashed into a vapor thereby absorbing the latent vaporization and cooling and de-superheating the hot vapor. As will be described below, the liquid-to-vapor module shown in FIG. 5 may be incorporated into the compressor's discharge line and may be supplied with liquid by any portion of the total condensing surface. This, coupled with the fact that the condensing coils 12 may be configured into several groups of stacks, permits construction of an extremely efficient condensing system of the type shown in FIG. 6.

Figure 6:
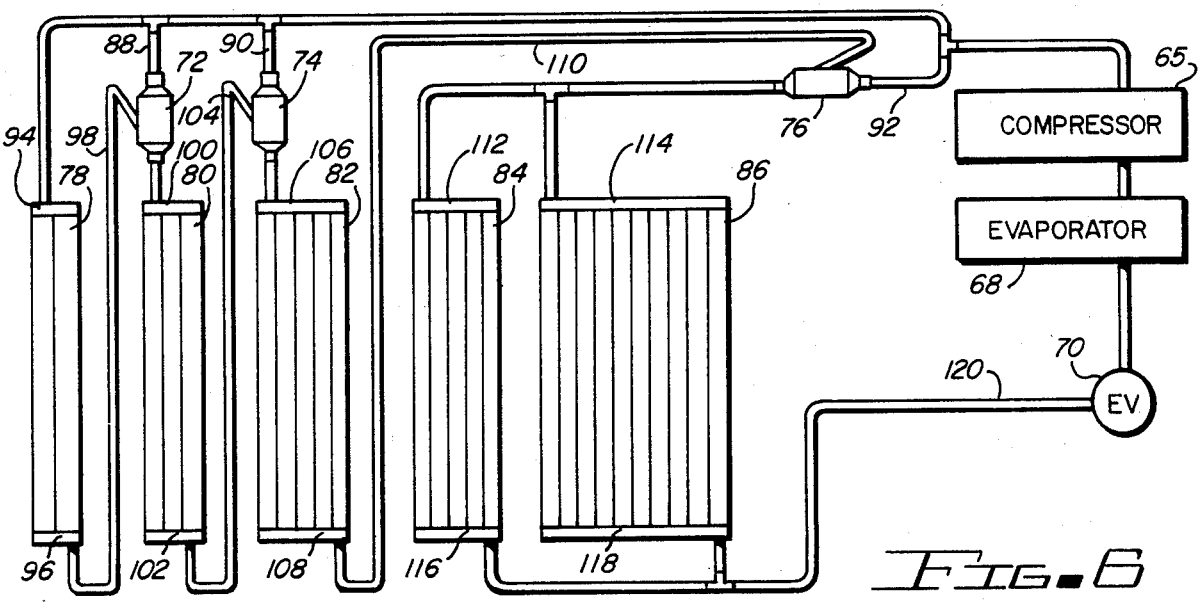
FIG. 6 illustrates a condensing apparatus in accordance with the present invention comprised of several groups of stacked condensing coils of the type shown in FIG. 4.

The condensing system shown in FIG. 6 comprises a compressor 66; an evaporator 68; 1 or more refrigeration controls 70, first, second and third liquid-to-vapor modules 72, 74 and 76, respectively; and first, second, third, fourth and fifth condensing coil stacks 78, 80, 82, 84 and 86, respectively, each of which may contain any desired number of condensing coils 12 of the type shown in FIG. 4. As can be seen, hot compressed vapor from compressor 66 is applied to the inlet sides of liquid-to-vapor modules 72, 74 and 76 via inlet tubes 88, 90 and 92, respectively. Hot vapor from compressor 66 is also applied to the feed header 94 of stack 78. Cooled refrigerant liquid is then transfered from outlet header 96 to the fluid input of liquid-to-vapor module 72 via conduit 98. Cooled vapor from module 72 is applied to the feeder header 100 of stack 80 and cooled refrigerant liquid is conveyed from outlet header 102 of stack 80 to the flared input of liquid-to-vapor module 74 via conduit 104. The output of module 74 is coupled to the feed header 106 of stack 82. In this case, cooled refrigerant liquid is conveyed from outlet header 108 of stack 82 to the fluid input of liquid-to-vapor module 76 via conduit 110. The output of module 76 is coupled to the feed headers 112 and 114 of stacks 84 and 86, respectively. Cooled liquid is then conveyed from outlet headers 116 and 118 of stacks 84 and 86, respectively, to refrigeration control(s) 70. The output of refrigeration control(s) 70 is coupled to evaporator 68 which in turn is coupled to the input of compressor 66. Thus, use is made of the liquid-to-vapor modules to cool the vapor which is applied to the input header of the condensing coil stacks in order to produce a more efficient system. As stated previously, each of the stacks may contain any desired number of condensing coils. Of course, the flow of liquid refrigerant may be bursted and pressurized and expanded through the use of one or more liquid refrigerant pumps. The liquid-to-vapor modules may be used in any refrigeration system operating at high, medium, low or ultra-low (cryogenic) operating temperatures with a condensor or condensors which are air cooled, air and water cooled, evaporative, or other cooling means and with any combination of condensing coil stacks and liquid-to-vapor modules. It should also be noted that the liquid-to-vapor module may be used singularly or in combination with other modules as is shown in FIG. 6.

The above description is given by way of example only. Changes in form and details may be made by one skilled in the art without departing from the scope of the invention. For example, each individual condensing coil 12 may be made from commercially available copper tubing or tubing of some other suitable material and may be formed free-hand, through the use of a jig, or from the use of a machine. Each coil may be made from a plain tube, or, if desired, each coil may be equipped with fins on its outside and/or inside. An internal divider may be used in the coil tubing as an option, or a smaller tube made of, for example copper, or other suitable material, may be placed inside the condensing coil tubing 12. This smaller tube may be for the purpose of carrying refrigerant or cooling medium or may be empty and used solely to occupy space. As already described, the coils may be piped as a unit and served by a feed header and an outlet header. As already shown, the condensing coil may be divided into subgroups each served by its own feed and outlet headers. The condensing apparatus described may be used alone or in conjunction with liquid-to-vapor modules. The condensing apparatus may be cooled by air, water, or evaporation and with or without evaporator or other precooling of the air which passes over and around the condensing coils. To the extent that such changes in form and details do not depart from the spirit of the invention, they are intended to be included within the scope thereof which is assessed only by a fair interpretation of the following claims.

Having fully described and disclosed the present invention in such clear and concise terms as to enable those skilled in the art to understand and practice the same, the invention claimed is:

1. A condensing apparatus for converting a hot vapor which is discharged at the outlet of a compressor into a cooled liquid which is supplied to a refrigeration control and then to an evaporator having an output coupled to the input of said compressor, said apparatus comprising:

a first stack of a first plurality of condensing coils having a feed header coupled to the output of said compressor for supplying hot vapor to each of said first plurality of condensing coils and having an outlet header for receiving cooled liquid from said first plurality of condensing coils;

at least a second stack of a second plurality of condensing coils having a feed header for supplying vapor to each of said second plurality of condensing coils and having an outlet header for receiving cooled liquid from said second plurality of condensing coils; and a vapor cooling module having first and second inputs and having an output coupled to the feed header of said second stack, said first input coupled to the output of said compressor for receiving hot vapor and said second input coupled to the outlet header of said first stack for receiving cooled liquid, said vapor cooling module for supplying a cooled vapor to the feed header of said second stack.

2. An apparatus according to claim 1 further comprising means for cooling said first and second stacks.

3. An apparatus according to claim 2 wherein said means for cooling comprises means for spraying said first and second stacks with water.

4. An apparatus according to claim 2 wherein said means for cooling comprises means for drawing cool air past said first and second stacks.

5. An apparatus according to claim 1 wherein said vapor cooling module comprises:

a first tube having an inlet section, an outlet section and an intermediate section positioned therebetween, said inlet section for receiving hot vapor; and a second tube having an inlet and having an outlet coupled to said intermediate section for introducing cool liquid therein which is flashed into a vapor producing a cooled vapor at said outlet section.

6. An apparatus according to claim 5 wherein said intermediate section has a diameter larger than that of said inlet and outlet sections.

7. An apparatus according to claim 6 wherein the outlet of said second tube is flared to facilitate introduction of said cool liquid into said intermediate section.

* * * * *